United States Patent [19]

Olivieri

[11] Patent Number: 4,651,392

[45] Date of Patent: Mar. 24, 1987

[54] TENSIONER ASSEMBLY FOR THE BINDING ARRANGEMENT OF AN ITEM OF SPORT FOOTWEAR, IN PARTICULAR A SKI BOOT

[75] Inventor: Oliviero Olivieri, Montebelluna, Italy

[73] Assignee: Icaro Olivieri & C. S.p.A., Montebelluna, Italy

[21] Appl. No.: 748,347

[22] Filed: Jun. 24, 1985

[30] Foreign Application Priority Data

Jun. 25, 1984 [IT] Italy ..... 22395/84[U]

[51] Int. Cl.[4] ..... A43C 11/00

[52] U.S. Cl. ..... 24/71 SK; 24/68 SK; 24/70 SK

[58] Field of Search ..... 24/68 SK–71 SK, 24/68 R, 69 R, 68 CD, 68 T, 71 R, 70 R; 36/50

[56] References Cited

U.S. PATENT DOCUMENTS

| | | | |
|---|---|---|---|
| 3,083,426 | 4/1963 | Neilson | 24/68 T |
| 3,887,966 | 6/1975 | Gley | 24/68 CD |
| 4,112,557 | 9/1978 | Salomon | 24/70 SK X |
| 4,193,171 | 3/1980 | Lichowsky | 24/68 SK |
| 4,424,636 | 1/1984 | Everest | 24/70 SK X |
| 4,433,457 | 2/1984 | Chalmers et al. | 24/71 SK X |
| 4,470,175 | 9/1984 | Chiarella | 24/70 SK |
| 4,541,147 | 9/1985 | Olivieri | 24/68 SK |

*Primary Examiner*—Peter A. Aschenbrenner

*Attorney, Agent, or Firm*—Fleit, Jacobson, Cohn & Price

[57] ABSTRACT

In a tensioner assembly including a lever, a tie having a hook-up member and an interlobing mechanism between the lever and the tie, which mechanism comprises a latch axially movably on the lever toward and away from an abutment seat formed on the tie member.

4 Claims, 5 Drawing Figures

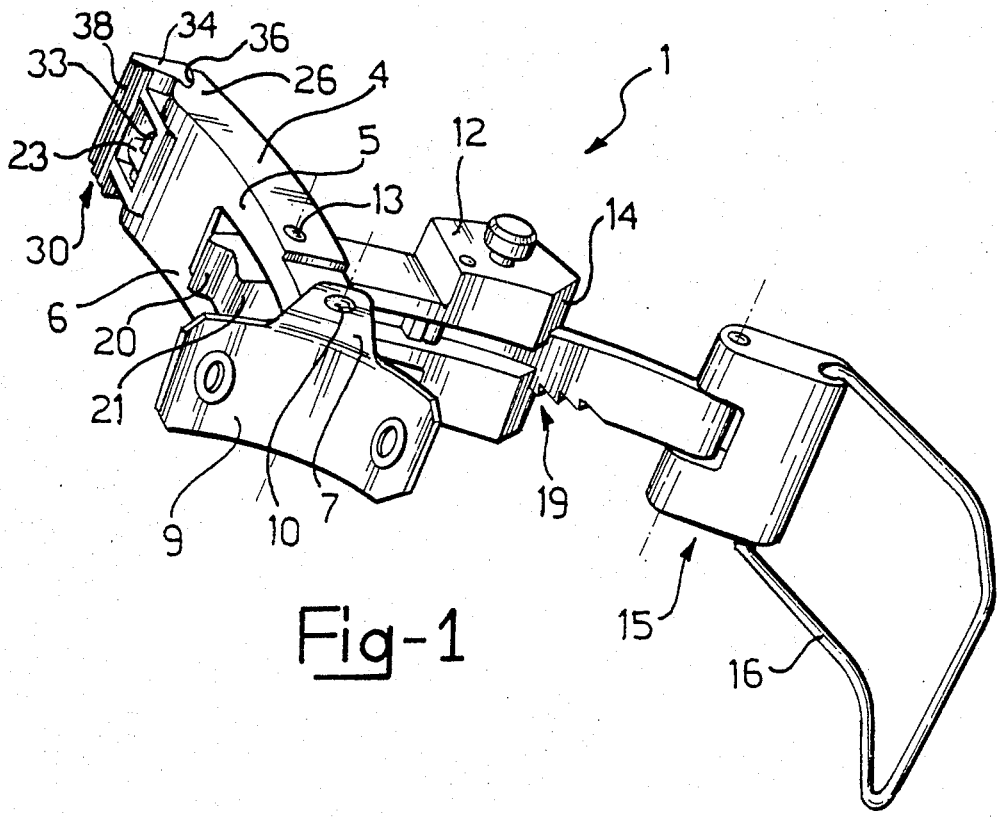
Fig-1
Fig-2
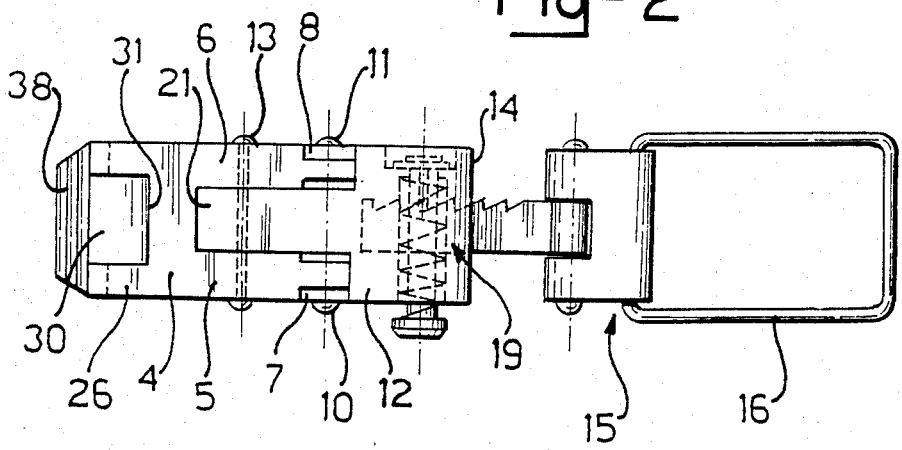

TENSIONER ASSEMBLY FOR THE BINDING ARRANGEMENT OF AN ITEM OF SPORT FOOTWEAR, IN PARTICULAR A SKI BOOT

BACKGROUND OF THE INVENTION

This invention relates to a tensioner assembly for the binding arrangement of an item of sport footwear, in particular but not exclusively useful for binding a ski boot.

For binding together two opposing flaps of a ski boot, it is current practice to employ tensioner assemblies of a type wherein a lever secured pivotally to either of said flaps in journalled to a tie member which has a hook-up member for engagement with the other of said flaps, and a second end in engagement with an interlocking mechanism on said lever.

Tensioner assemblies of that type have been mainly provided in order to reduce the bulk size of the binding arrangement, and provide more compact boot designs without awkwardly protruding appendages.

It had been recognized, in fact, that it was not possible to arbitrarily reduce the thickness of the lever and tie member without this involving two disadvantages: first, the finger grip space available for the binding operation is reduced; secondly, the traditional effectiveness of the overcenter closure is lost because the overcenter travel length is too short.

The first disadvantage has been overcome by providing an auxiliary lever journalled to the end of the main lever; to release the binding, the auxiliary lever is first raised to provide adequate grip surface area.

The second disadvantage has been overcome by providing some interlocking devices between the main lever and tie member.

Known interlocking devices comprise a number of parts which are kinematically connected to one another (and often to the aforesaid auxiliary lever as well) and form a fairly complex mechanism liable to jam especially where snow and ice deposits occur. In fact, any snow getting under the main lever tends to fill the many voids therein, thus completely blocking the movements of the parts. Additionally, in such a circumstance, it would not even be possible to remove the snow and ice deposits on account of their being inaccessible.

SUMMARY OF THE INVENTION

It is an object of this invention to provide a tensioner assembly of the type indicated, which can overcome all of the cited drawbacks affecting prior art approaches.

This object is achieved by a tensioner assembly which comprises:

an actuating lever secured pivotally to either of the cited flaps, a tie member having a first end operatively connected to a hook-up member for engagement with the other of the cited flaps, and a second end in engagement with an interlocking mechanism on said lever, wherein said interlocking mechanism includes, a latch guided axially within said lever;

an elastic bias means for urging said latch into engagement with a corresponding abutment seat on the second end of the tie member;

an auxiliary lever mounted movably on the free end of said actuating lever to form substantially and extension thereof and being connected mechanically to said latch for actuating it through said seat against the bias of said elastic bias means.

BRIEF DESCRIPTION OF THE DRAWINGS

Further features and advantages of a tensioner assembly according to the invention will be more clearly understood from the following description of a preferred embodiment thereof, with reference to the accompanying drawings, where:

FIG. 1 is a perspective view of a tensioner assembly according to the invention, shown in its released condition;

FIG. 2 is a plan view of the tensioner assembly of FIG. 1, shown in its fastened condition;

DESCRIPTION OF THE PREFERRED EMBODIMENT

Figure 3:
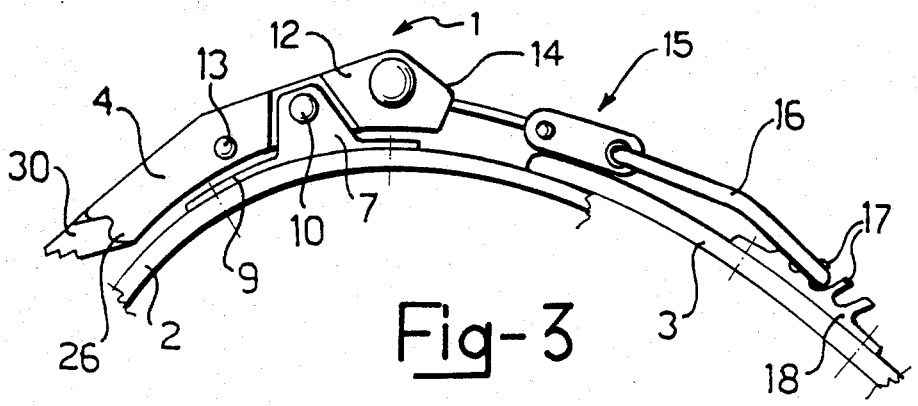
FIG. 3 is a side view of the tensioner assembly of FIG. 1, shown in its fastened condition.

In the drawing figures, the reference numeral 1 designates generally a tensioner assembly for binding or fastening together two opposing flaps 2 and 3 of an item of sport footwear, in particular a ski boot (not shown).

The assembly 1 comprises an actuating lever 4 of flattened and slightly arcuate shape, which is formed with a center slot defining a pair of parallel side arms 5 and 6 connected pivotally to a pair of brackets 7 and 8 formed integrally with a plate-like support 9 relatively whereto the brackets 7 and 8 extend substantially perpendicularly. The support 9 is secured rigidly to the flap 2 in a conventional manner, such as by means of screws or rivets (not shown). The lever 4 is journalled to the brackets 7 and 8 by means of two rivets, 10 and 11.

A tie member 12 is journalled to the lever 4, between the arms 5 and 6, by a pin 13. The tie member has a first end 14 operatively connected to a hook-up member, generally indicated at 15, of a type wherein a substantially annular element 16, adapted for engagement with any of a plurality of hooks 17 on a plate 18 attached to the flap 3 in a conventional way, is positionable adjustably with respect to the tie member 12 by means of a conventional fine adjustment mechanism, such as a rack-type mechanism, generally indicated at 19.

The tie member 12 has a substantially stepped abutment seat 20 formed at a second end 21 thereof, for engagement with an interlocking device, generally indicated at 22.

The interlocking device 22 comprises a rod-like latch 23 guided axially in the lever 4 through a hole 25 formed through the lever 4 at a location close to its free end 26. Formed on the latch 23 and in the hole 25 are two respective shoulders 27 and 28 holding a spring 29 compressed therebetween to bias the latch 23 into engagement with the seat 20 in the tie member 12.

The interlocking device 22 further comprises an auxiliary lever 30 mounted movably on the free end 26 of the lever 4 to form a substantial extension thereof and being connected mechanically to the latch 23 to actuate it away from the seat 20, against the bias of the spring 29.

Specifically, the auxiliary lever 30 has a rest wall 31 wherein there is formed an opening 32 for the latch 23, and against which a stop pin 33, inserted crosswise through the latch 23, is brought to bear. The auxiliary lever 30 also has two wings 34 and 35, which are held within respective recesses 36 and 37 on the end 26 of the lever 4 by the action of the spring 29. The lever 30 is provided, moreover, with a knurled grip end 38.

Figure 4:
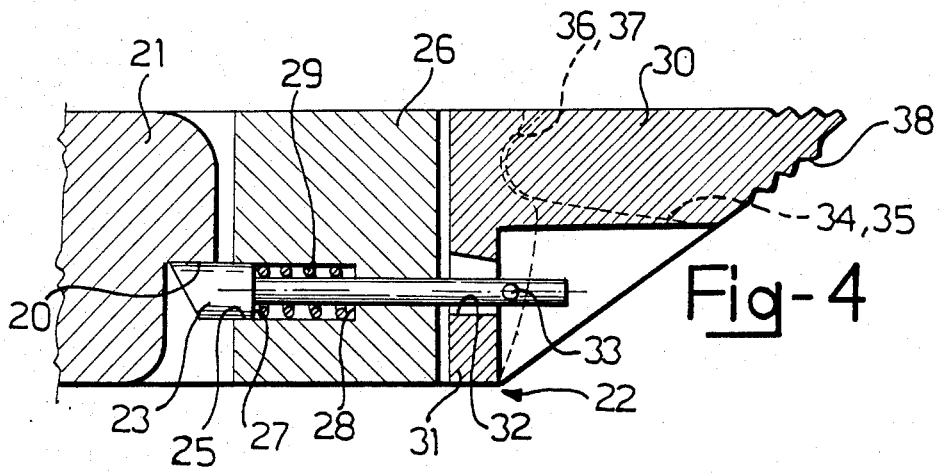
FIGS. 4 and 5 are enlarged scale sectional views of the free end of the lever of the tensioner assembly of FIG. 1, respectively in its fastened condition and while being released or unfastened.
Figure 5:
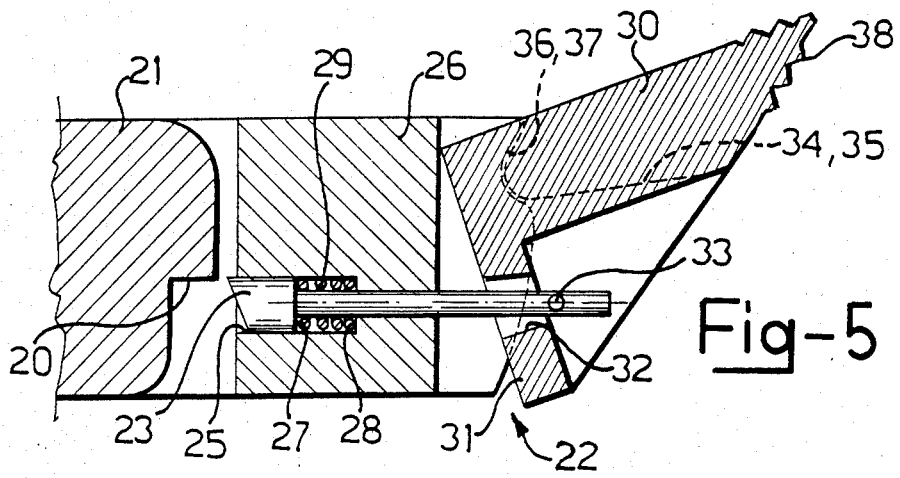

The operation and utilization of the tensioner assembly 1 will be now described with particular reference to FIGS. 3,4 and 5.

With the tensioner assembly 1 in its fastened condition, holding is ensured, additionally to the customary overcenter effect owed to the relative lay of the axes of the rivets 10 and 11, and of the pin 13, also by the latch 23 engaging with the seat 20 on the end 21 of the tie member 12. By virtue of that engagement, any relative movements of the actuating lever 4 and tie member 12 are inhibited, which will prevent incidental release or unfastening of the assembly.

Where the tensioner assembly 1 is to be released or unfastened, it will be sufficient that the lever 4 be moved by acting on the auxiliary lever 30. As shown in FIG. 5, on raising the lever 30, the latch 30 is pulled away from the seat 20 through the pin 33; thus, the tie member 12 and lever 4 are released, and the lever 4 may be fully raised to unfasten the boot.

As may be appreciated, a tensioner assembly according to the invention has a height dimension which is indeed minimal, while ensuring both the binding holding power and easy and quick unfastening features thanks to the interlocking mechanism provided.

Furthermore, the particular interlocking mechanism of a tensioner assembly according to this invention is not liable to jam owing to any snow or ice deposit formations. In fact, the single inner cavity (the hole 25) would be covered at all times by the latch 23 and, therefore, shut off to snow.

Finally, the peculiarly simple construction of a tensioner assembly according to the invention is noteworthy, which is undoubtedly superior to prior assembly constructions.

I claim:

1. A tensioning assembly for binding two opposing closure flaps of a ski boot, said assembly comprising:

an actuating lever pivotally mounted on one of said two flaps, a tie member having a first end connected to a hook-up member for engagement with the other of said two flaps, and having a second end pivotally mounted on said actuating lever, and an interlocking mechanism mounted on said actuating lever for locking said actuating lever with said second end, said interlocking mechanism including a latch slidably mounted in said actuating lever for movement along a longitudinal axis of said actuating lever, an abutment seat defined by said second end, said latch being guided axially away from and toward said abutment seat, bias means for biasing said latch into engagement with said abutment seat, said bias means being shielded for protection against exposure to snow and ice, and an auxiliary lever pivotally mounted on a free end of said actuating lever for movement toward and away from said actuating lever, said auxiliary lever being aligned with said actuating lever as a continuous extension thereof in a first position for locking of said latch with said abutment seat, and said auxiliary lever being connected to said latch for actuation of said latch by movement of said auxiliary lever and by the bias of said bias means, said auxiliary lever being moveable to a second position against the bias of said bias means for disengaging said latch from said abutment seat to allow lifting of said actuating lever to thereby disengage said tie member from said other flap.

2. A tensioner assembly according to claim 1, wherein said auxiliary lever includes a knurled finger-grip end for gripping of said auxiliary lever when said auxiliary lever is moved to said second position, a rest wall, and an opening defined by said rest wall within which said latch is slidably mounted, said latch including a pin extending through said latch, transverse to said longitudinal axis of said latch and said pin bears against said rest wall.

3. A tensioner assembly according to claim 2, wherein said auxiliary lever includes two wings bearing against respective recesses in said free end of said actuating lever.

4. A tensioner assembly according to claim 1, wherein said bias means is totally enclosed within said actuating lever.

* * * * *